US011057972B1

(12) United States Patent
De Cicco et al.

(10) Patent No.: US 11,057,972 B1
(45) Date of Patent: Jul. 6, 2021

(54) CONTROLLING LED INTENSITY BASED ON A DETECTED PHOTOCURRENT VALUE

(71) Applicant: Infineon Technologies AG, Neubiberg (DE)

(72) Inventors: Adolfo De Cicco, Castel d'Azzano (IT); Rosario Chiodo, Selvazzano Dentro (IT); Andrea Logiudice, Montegrotto Terme (IT); Dietrich Bonart, Bad Abbach (DE); Thomas Gross, Sinzing (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 16/837,322

(22) Filed: Apr. 1, 2020

(51) Int. Cl.
*H05B 45/14* (2020.01)
*H05B 45/46* (2020.01)
*H05B 45/345* (2020.01)

(52) U.S. Cl.
CPC ..... *H05B 45/345* (2020.01); *H05B 45/14* (2020.01); *H05B 45/46* (2020.01)

(58) Field of Classification Search
None
See application file for complete search history.

(56) References Cited

U.S. PATENT DOCUMENTS 8,705,015 B2 4/2014 Chang et al.
2012/0293078 A1 11/2012 Logiudice et al.

FOREIGN PATENT DOCUMENTS

TW 202002150 A * 10/2010 ..... H05B 37/02

* cited by examiner

*Primary Examiner* — Dedei K Hammond
(74) *Attorney, Agent, or Firm* — Shumaker & Sieffert, P.A.

(57) ABSTRACT

This disclosure includes systems, methods, and techniques for controlling a plurality of light-emitting diodes (LEDs). For example, a circuit includes a switching device, where the switching device is electrically connected to an LED of the plurality of LEDs, and where the switching device is configured to control whether the LED receives an electrical signal from a power source. Additionally, the circuit includes processing circuitry configured to receive a photocurrent signal indicative of a photocurrent value corresponding to the LED, compare the photocurrent value with a threshold photocurrent value, and control, based on the comparison of the photocurrent value with the threshold photocurrent value, an output current of the LED.

22 Claims, 8 Drawing Sheets

CONTROLLING LED INTENSITY BASED ON A DETECTED PHOTOCURRENT VALUE

TECHNICAL FIELD

This disclosure relates circuits for driving and controlling light-emitting diodes.

BACKGROUND

Driver circuits are often used to control a voltage, current, or power at a load. For instance, a light-emitting diode (LED) driver may control the power supplied to a string of light-emitting diodes. In some cases, LED driver circuits may accept an input signal including an input current and an input voltage and deliver an output signal including an output current and an output voltage. In some such cases, an LED driver circuit may regulate at least some aspects of the input signal and the output signal, such as controlling the output current emitted by the LED driver circuit. In some examples, an LED driver circuit may control a light intensity of a corresponding LED.

SUMMARY

In general, this disclosure is directed to devices, systems, and techniques for measuring a photocurrent value corresponding to a light-emitting diode (LED) of a plurality of LEDs and adjusting an output current of the LED based on the measured photocurrent value. In some examples, it may be beneficial to regulate a light intensity of the plurality of LEDs in order to maintain a uniform intensity across each LED of the plurality of LEDs. In other words, it may be beneficial to prevent one or more LEDs of the plurality of LEDs from having a light intensity which is significantly different from other LEDs of the plurality of LEDs. According to techniques of this disclosure, processing circuitry may determine a photocurrent value associated with an LED of the plurality of techniques and modify a duty cycle of the LED in order to achieve a target light intensity for the LED. In some examples, the processing circuitry may adjust an input current to the LED in order to achieve a target light intensity for an LED. Additionally, in some cases, a temperature sensor may determine a temperature of an area proximate the plurality of LEDs. The processing circuitry may determine, in some cases, the duty cycle of an LED for causing the LED to meet a target light intensity based on a temperature proximate to the LED.

In some examples, a circuit for controlling a plurality of LEDs includes a switching device, wherein the switching device is electrically connected to an LED of the plurality of LEDs, and wherein the switching device is configured to control whether the LED receives an electrical signal from a power source. Additionally, the circuit includes processing circuitry configured to receive a photocurrent signal indicative of a photocurrent value corresponding to the LED, compare the photocurrent value with a threshold photocurrent value, and control, based on the comparison of the photocurrent value with the threshold photocurrent value, an output current of the LED.

In some examples, a method for controlling a plurality of LEDs includes receiving, by processing circuitry, a photocurrent signal indicative of a photocurrent value corresponding to an LED of a plurality of LEDs, wherein a switching device is electrically connected to the LED, and wherein the switching device is configured to control whether the LED receives an electrical signal from a power source, comparing, by the processing circuitry, the photocurrent value with a threshold photocurrent value, and controlling, by the processing circuitry based on the comparison of the photocurrent value with the threshold photocurrent value, an output current of the LED.

In some examples, a system for controlling a plurality of LEDs includes the plurality of LEDs, a switching device, wherein the switching device is electrically connected to an LED of the plurality of LEDs, and wherein the switching device is configured to control whether the LED receives an electrical signal from a power source, and processing circuitry. The processing circuitry are configured to receive a photocurrent signal indicative of a photocurrent value corresponding to the LED, compare the photocurrent value with a threshold photocurrent value, and control, based on the comparison of the photocurrent value with the threshold photocurrent value, an output current of the LED.

The summary is intended to provide an overview of the subject matter described in this disclosure. It is not intended to provide an exclusive or exhaustive explanation of the systems, devices, and methods described in detail within the accompanying drawings and description below. Further details of one or more examples of this disclosure are set forth in the accompanying drawings and in the description below. Other features, objects, and advantages will be apparent from the description and drawings, and from the claims.

BRIEF DESCRIPTION OF DRAWINGS

Like reference characters denote like elements throughout the description and figures.

DETAILED DESCRIPTION

Some lighting systems may control a set of switching devices, where each switching device of the set of switching devices controls whether a respective light emitting diode (LED) of a set of LEDs receives an electrical signal from a power source. In some examples, processing circuitry may be configured to control the set of switching devices in order to control a light intensity of each LED of the set of LEDs based on a target light intensity. For example, the processing circuitry may set a duty cycle corresponding to a switching device of the set of switching devices which controls a respective LED of the set of LEDs. The duty cycle of the switching device may be correlated with a light intensity of the respective LED. As such, increasing the duty cycle of the switching device may cause the light intensity of the respective LED to increase and decreasing the duty cycle of the LED may cause the light intensity of the respective LED to increase. Moreover, altering an input current to the LED may have an effect on the light intensity of the LED.

Automotive LED front lights may feature pixelated light sources which allow individual brightness control of a pixels or a group of pixel groups. This may allow new light functions such as glare-free high beam systems. To provide such functionality it may be beneficial for a high-resolution lighting system to light to a field of view. For example, an LED matrix may include a large number of LEDs (e.g., within a range from 10,000 LEDs to 20,000 LEDs) which allow a chip-on-chip concept where the LED matrix is mounted over a light source matrix.

Figure 1:
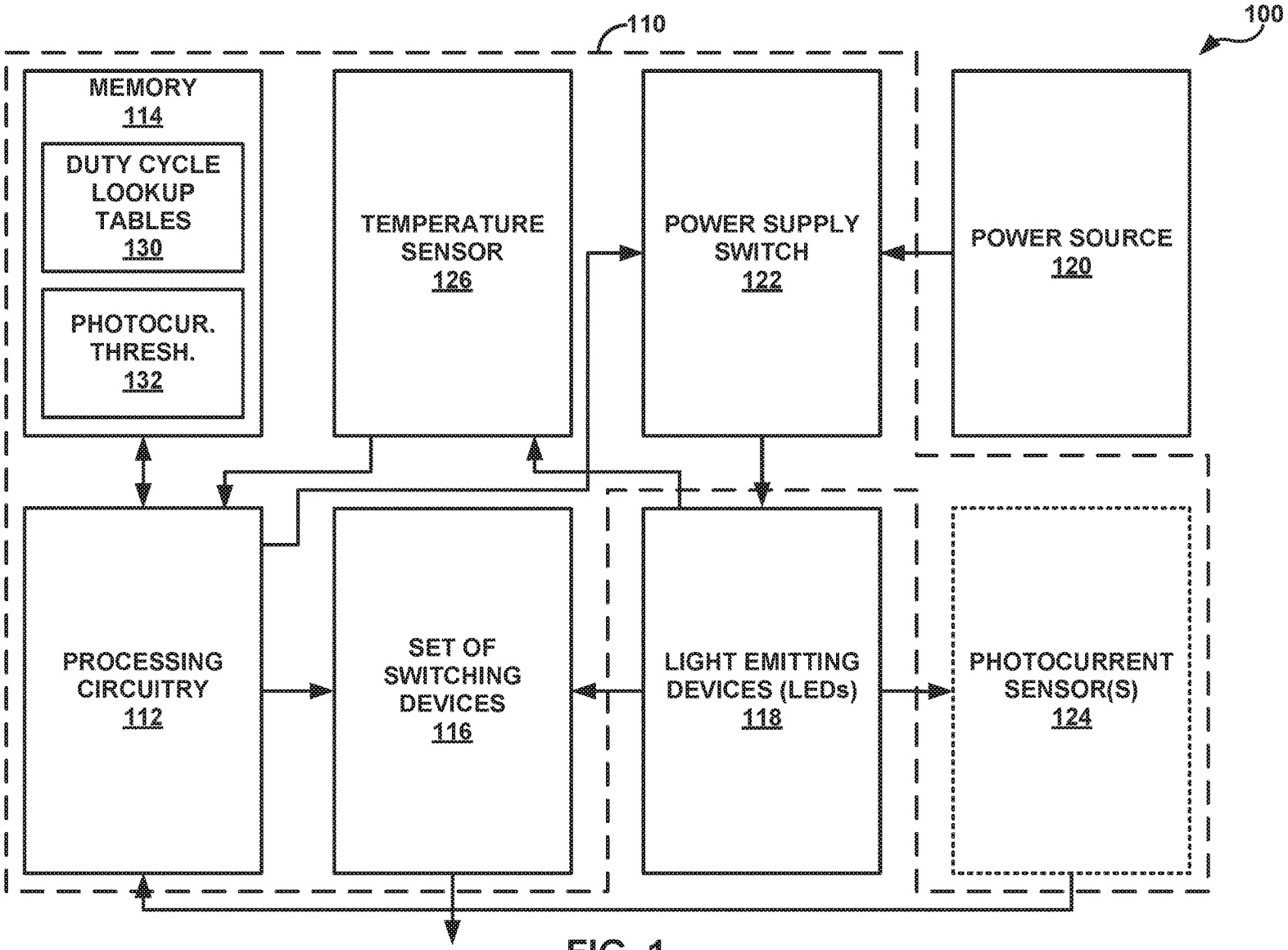
FIG. 1 is a block diagram illustrating a system for controlling a light intensity of a plurality of light-emitting diodes (LEDs), in accordance with one or more techniques of this disclosure.

FIG. 1 is a block diagram illustrating a system 100 for controlling a light intensity of a plurality of LEDs, in accordance with one or more techniques of this disclosure. As illustrated in the example of FIG. 1, system 100 includes circuit 110, LEDs 118, and power source 120. Circuit 110 includes processing circuitry 112, memory 114 a set of switching devices 116, power supply switch 122, one or more photocurrent sensors 124, and temperature sensor 126. Memory 114 may be configured to store duty cycle lookup tables 130 and photocurrent thresholds 132.

In some examples, system 100 represents a system for controlling each LED of LEDs 118 such that each LED of LEDs 118 emits light at a target light intensity value. For example, it may be beneficial for each LED of LEDs 118 to emit light at approximately the same light intensity as each other LED of LEDs 118, so that LEDs 118 appear to have a uniform brightness. System 100 may measure a brightness (e.g., light intensity) of one or more LEDs of LEDs 118 in order to determine whether to adjust the brightness of the one or more LEDs.

Processing circuitry 112, in some examples, may include one or more processors that are configured to implement functionality and/or process instructions for execution within system 100. For example, processing circuitry 112 may be capable of processing instructions stored in memory 114. Processing circuitry 112 may include, for example, microprocessors, digital signal processors (DSPs), application specific integrated circuits (ASICs), field-programmable gate arrays (FPGAs), or equivalent discrete or integrated logic circuitry, or a combination of any of the foregoing devices or circuitry. Accordingly, processing circuitry 112 may include any suitable structure, whether in hardware, software, firmware, or any combination thereof, to perform the functions ascribed herein to processing circuitry 112.

In some examples, memory 114 includes computer-readable instructions that, when executed by processing circuitry 112, cause system 100 to perform various functions attributed to system 100 herein. Memory 114 may include any volatile, non-volatile, magnetic, optical, or electrical media, such as a random access memory (RAM), read-only memory (ROM), non-volatile RAM (NVRAM), electrically-erasable programmable ROM (EEPROM), flash memory, or any other digital media.

Switching devices 116 may, in some cases, include power switches such as, but not limited to, any type of field-effect transistor (FET) including any combination of metal-oxide-semiconductor field-effect transistors (MOSFETs), bipolar junction transistors (BJTs), insulated-gate bipolar transistors (GBTs), junction field effect transistors (JFETs), high electron mobility transistors (HEMTs), or other elements that use voltage or current for control. Additionally, switching devices 116 may include n-type transistors, p-type transistors, and power transistors, or any combination thereof. In some examples, switching devices 116 include vertical transistors, lateral transistors, and/or horizontal transistors. In some examples, switching devices 116 include other analog devices such as diodes and/or thyristors. In some examples, switching devices 116 may operate as switches and/or as analog devices.

In some examples, each of switching devices 116 include three terminals: two load terminals and a control terminal. For MOSFET switches, each of switching devices 116 may include a drain terminal, a source terminal, and at least one gate terminal, where the control terminal is a gate terminal. For BJT switches, the control terminal may be a base terminal. Current may flow between the two load terminals of each of switching devices 116, based on the voltage at the respective control terminal. Therefore, electrical current may flow across switching devices 116 based on control signals delivered to the respective control terminals of switching devices 116. In one example, if a voltage applied to the control terminals of switching devices 116 is greater than or equal to a voltage threshold, switching devices 116 may be activated, allowing switching devices 116 to conduct electricity. Furthermore, switching devices 116 may be deactivated when the voltage applied to the respective control terminals of switching devices 116 is below the threshold voltage, thus preventing switching devices 16 from conducting electricity. Processing circuitry 112 may be configured to independently control switching devices 116 such that one, a combination, all, or none of switching devices 116 may be activated at a point in time.

Switching devices 116 may include various material compounds, such as Silicon, Silicon Carbide, Gallium Nitride, or any other combination of one or more semiconductor materials. In some examples, silicon carbide switches may experience lower switching power losses. Improvements in magnetics and faster switching, such as Gallium Nitride switches, may allow switching devices 116 to draw short bursts of current. These higher frequency switching devices may require control signals (e.g., voltage signals delivered by processing circuitry 112 to respective control terminals of switching devices 116) to be sent with more precise timing, as compared to lower-frequency switching devices.

LEDs 118 may include any suitable semiconductor light source. In some examples, an LED may include a p-n junction configured to emit light when activated. In some examples, LEDs 118 may be included in a headlight assembly for automotive applications. For instance, LEDs 118 may include a matrix, a string, or more than one string of light-emitting diodes to light a road ahead of a vehicle. As used herein, a vehicle may refer to motorcycles, trucks, boats, golf carts, snowmobiles, heavy machines, or any type of vehicle that uses directional lighting.

Each switching device of the set of switching devices 116 may control an amount of power that a respective LED of LEDs 118 receives from power source 120. For example, when a switching device of switching devices 116 is turned on, an electrical current may flow from power source 120 across the LED corresponding to the switching device and across the switching device itself, causing the LED to emit photons (e.g., light). When the switching device is turned off, the switching device may prevent electrical current from flowing across the respective LED of LEDs 118, thus preventing the LED from emitting photons.

In some examples, to control a light intensity of each LED of LEDs 118, processing circuitry 112 may output control signals for controlling each switching device of switching devices 116 to allow a predetermined amount of electrical current to flow across each LED of LEDs 118. For example, a switching device of switching devices 116 may cycle between an 'on' state and an 'off' state at a duty cycle and at a frequency. As used herein, the term "duty cycle" refers to a ratio of an amount of time that the switching device is in the on state to an amount of time that the switching device in in the off state and the term "frequency" refers to a number of switching cycles completed per unit of time. As an example, when processing circuitry 112 controls a switching device of switching devices 116 to cycle between the on state and the off state at a frequency of 1 kilohertz (KHz) and at a duty cycle of 0.9, the switching device may perform 1,000 switching cycles per second, where an on phase of the switching device lasts nine times as long as an off phase of the switching device.

The duty cycle of a first switching device of switching devices 116 may be correlated with a light intensity of a corresponding first LED of LEDs 118. For example, when processing circuitry 112 increases a duty cycle in which the first switching device cycles between the on phases and off phases, a light intensity of the first LED may increase and when processing circuitry 112 decreases a duty cycle in which the first switching device cycles between the on phases and off phases, a light intensity of the first LED may decrease. This provides processing circuitry 112 individual control over the light intensity of each LED of LEDs 118. For example, the duty cycle of a second switching device of switching devices 116 may be correlated with a light intensity of a corresponding second LED of LEDs 118. Processing circuitry 112, in some cases, may control the first switching device and the second device such that the first LED and the second LED emit light at the same or a similar light intensity. Alternatively, processing circuitry 112 may control the first switching device and the second device such that the first LED and the second LED emit light at different light intensities, in some cases. However, it may be beneficial for each LED of LEDs 118 to emit light at approximately the same light intensity so that LEDs 118 appear to have a uniform brightness.

LEDs 118, in some examples, may represent a matrix of LEDs having a number of rows and a number of columns. LEDs 118 may include a number of LEDs within a range from 1,000, to 10,000, but this is not required. LEDs 118 may include any number of LEDs. It might be the case that a nature of a connection between each LED of LEDs 118 and power source 120 and/or a nature of a connection between each LED of LEDs 118 and a respective switching device of switching devices 116 may be slightly different. For example, connections between LEDs 118 and power source 120 and connections between LEDs 118 and switching devices 116 may vary based on strength. For example, a first connection between the first LED of LEDs 118 and power source 120 may be stronger than a second connection between the first LED of LEDs 118 and power source 120. In this example, for processing circuitry 112 to control the first LED and the second LED to emit light at the same or nearly the same light intensity, processing circuitry 112 may control the first switching device corresponding to the first LED to cycle between the on state and the off state at a first duty cycle value and processing circuitry 112 may control the second switching device corresponding to the second LED to cycle between the on state and the off state at a second duty cycle value, where the second duty cycle is greater than the first duty cycle value. In other words, since the first connection between the first LED and power source 120 is stronger than the second connection between the second LED and power source 120, allowing more current to flow through the first LED than the second LED, processing circuitry 112 may set the duty cycle of the first switching device to be lower than the duty cycle of the second switching device in order to adjust for the relative strength advantage of the first connection over the second connection.

Power source 120 is configured to deliver operating power to circuit 110. In some examples, power source 120 includes a battery and a power generation circuit to produce operating power. In some examples, power source 120 is rechargeable to allow extended operation. Power source 120 may include any one or more of a plurality of different battery types, such as nickel cadmium batteries and lithium ion batteries. In some examples, a maximum voltage output of power source 120 is approximately 12V. In some examples, power source 120 supplies power within a range from 10 Watts (W) to 15 W.

Power supply switch 122 may represent a switch which controls a flow of electrical current from power source 120 to LEDs 118. Power supply switch 122 may, in some cases, include power switches such as, but not limited to, any type of FET including any combination of a MOSFET, a BJT, an IGBT, a JFET, an HEMTs, or another element that uses voltage or current for control. Additionally, power supply switch 122 may include n-type transistors, p-type transistors, and power transistors, or any combination thereof. In some examples, power supply switch 122 includes vertical transistors, lateral transistors, and/or horizontal transistors. In some examples, power supply switch 122 includes other analog devices such as diodes and/or thyristors. In some examples, power supply switch 122 may operate as switches and/or as analog devices.

Processing circuitry 112 may control power supply switch 122 in order to control the flow of electrical current from power source 120 to LEDs 118. In some examples, processing circuitry 112 may adjust a duty cycle of power supply switch 122 in order to increase or decrease an amount of electrical current flowing from power source 120 to LEDs 118. In some cases, power supply switch 122 may control a flow of electrical current from power source 120 to all of LEDs 118, whereas each switching device of switching devices 116 controls a flow of electrical current across one or more respective LEDs of LEDs 118. In this way, switching devices 116 may allow processing circuitry 112 to individually control a light intensity of each LED of LEDs 118 and power supply switch 122 may allow processing circuitry 112 to collectively control a light intensity of all of LEDs 118.

It may be beneficial for processing circuitry 112 to control switching devices 116 so that each LED of LEDs 118 emit light at approximately the same light intensity. In some examples, photocurrent sensor(s) 124 may generate a photocurrent signal corresponding to at least one LED of LEDs 118. For example, a photocurrent signal corresponding to an LED of LEDs 118 may indicate a light intensity of at the LED. In some examples, photocurrent sensor(s) 124 may represent a set of integrated photocurrent sensors, the set of integrated photocurrent sensors including an integrated photocurrent sensor corresponding to each LED of LEDs 118. In some examples, photocurrent sensor(s) 124 may represent a group of LEDs 118. For example, when an LED is turned off, it may be configured to perform as a photodetector, sensing one or more photons emitted by a light source proximate to the photo-detecting LED. Photocurrent sensor(s) may, in some cases, represent a group of LEDs of LEDs 118 which are proximate to an LED of LEDs 118 which is undergoing brightness testing. In some cases, one or more LEDs of LEDs 118 undergoing brightness testing may change over time, and the LEDs representing photocurrent sensors 124 may change based on which LEDs of LEDs 118 are undergoing brightness testing.

A first switching device of switching device 116 may control an amount of electrical current which flows through a first LED of LEDs 118 from power source 120. Processing circuitry 112 may perform a brightness test on the first LED. In order to perform the brightness test, processing circuitry 112 may receive a first photocurrent signal indicative of a first photocurrent value corresponding to the first LED of LEDs 118. In some examples, the first photocurrent signal may be correlated with a light intensity of the first LED. Processing circuitry 112 may compare the first photocurrent value with a threshold photocurrent value. The threshold photocurrent value may, in some cases, be a threshold photocurrent value stored in memory 114 as one of photocurrent thresholds 132. Subsequently, processing circuitry 112 may control, based on the comparison of the first photocurrent value with the threshold photocurrent value, an output current of the first LED. In some examples, processing circuitry 112 may control the output current of the first LED by controlling the first switching device of the set of switching devices 116. In some examples, processing circuitry 112 may control the output current of the first LED by controlling power supply switch 122.

In some examples, to control the output current of the first LED, processing circuitry 112 is configured to adjust, based on the comparison between the first photocurrent value and the threshold photocurrent value, a duty cycle of the first switching device from a first duty cycle value to a second duty cycle value (e.g., change the current duty cycle value to a new duty cycle value). Subsequently, processing circuitry 112 modulates the first switching device at the second duty cycle value. In some examples, to compare the first photocurrent value with the threshold photocurrent value, processing circuitry 112 is configured to determine a difference between the first photocurrent value and the threshold photocurrent value. Processing circuitry 112 may select the threshold photocurrent value from photocurrent thresholds 132 based on one or both of a temperature proximate to LEDs 118 and a desired light intensity of the first LED. For example, photocurrent thresholds 132 may include one or more tables of threshold photocurrent values which associate threshold photocurrent values with temperature values and desired light intensity values.

In some examples, to adjust the duty cycle value of the first LED from the first duty cycle value to the second duty cycle value, processing circuitry 112 is configured to identify a duty cycle delta value based on the difference between the first photocurrent value and the threshold photocurrent value. In some examples, the duty cycle delta value may represent an amount in which to change a duty cycle of the first switching device of the set of switching devices 116 so that the first LED of LEDs 118 emits light at the target light intensity value accounting for the temperature proximate to LEDs 118. Duty cycle lookup tables 130 may include a set of lookup tables which associate duty cycle delta values with respective differences between measured photocurrent values and threshold photocurrent values and respective temperature values proximate to LEDs 118. For example, duty cycle lookup tables 130 may include a set of duty cycle lookup tables each corresponding to a different temperature value. Each duty cycle lookup table of the set of duty cycle lookup tables may associate each duty cycle delta value of a set of duty cycle delta values with a respective difference between a threshold photocurrent value and a measured threshold photocurrent value. In this way, processing circuitry 112 may select a lookup table of duty cycle lookup tables 130 based on a temperature signal received from temperature sensor 126 which indicates a temperature proximate to LEDs 118. Processing circuitry 112 may identify, in the selected lookup table of duty cycle lookup tables 130 the duty cycle delta value based on the calculated difference between the first photocurrent signal corresponding to the first LED and the threshold photocurrent signal.

Processing circuitry 112 may adjust the duty cycle of the first switching device from the first duty cycle value to the second duty cycle value by calculating the second duty cycle to be a sum of the first duty cycle value and the duty cycle delta value. In this way, processing circuitry 112 may change a current duty cycle of the first switching device by the duty cycle delta value. In some examples, to control the output current of the LED of LEDs 118 in order to control the light intensity of the LED, processing circuitry 112 is configured to adjust an input current to the LED from a first input current value to a second input current value. In some examples, to adjust the input current to the LED, processing circuitry 112 alters a frequency or a duty cycle of power supply switch 122.

Photocurrent sensor(s) 124, in some cases, may be located proximate to one or more LEDs of LEDs 118 which are undergoing light intensity testing. Photocurrent sensor(s) 124 are configured to generate a photocurrent signal corresponding to the one or more LEDs which are undergoing light intensity testing and output the photocurrent signal to processing circuitry 112.

In some examples, photocurrent sensor(s) 124 include one or more integrated photocurrent sensors, each integrated photocurrent sensor of the one or more integrated photocurrent sensors representing a photodiode integrated with a respective LED of LEDs 118. To generate a photocurrent signal indicating a light intensity of an LED of LEDs 118, the photodiode is configured to generate the photocurrent signal to indicate a photocurrent value which is proportional to a light intensity of the LED. In at least some examples where the photocurrent sensor(s) 124 represent integrated photodiodes, an integrated photodiode may be configured to detect an amount of leakage current associated the LED of LEDs 118 and generate the photocurrent signal to indicate the photocurrent value based on the amount of leakage current associated with the LED of LEDs 118.

In some examples, LEDs 118 form an LED matrix that includes a number of columns and a number of rows and photocurrent sensor(s) 124 include a group of one or more sensing LEDs of LEDs 118 (e.g., "sensing LEDs") which are proximate to an LED of LEDs 118 which processing circuitry 112 is currently testing for brightness. For example, processing circuitry 112 may turn on the LED which is undergoing brightness testing, and processing circuitry 112 may turn off the group of sensing LEDs which include LEDs that are adjacent to the LED undergoing brightness testing. In some examples, the group of sensing LEDs are configured to generate the photocurrent signal to include a set of photocurrent value components, wherein each photocurrent value component of the set of photocurrent value components corresponds to a respective sensing LED of the group of one or more sensing LEDs. In some examples, processing circuitry 112 is configured to determine the photocurrent value corresponding to the LED based on a mean photocurrent value component of the set of photocurrent value components. In some examples, processing circuitry 112 is configured to determine the photocurrent value corresponding to the LED based on a median photocurrent value component of the set of photocurrent value components.

Figure 2:
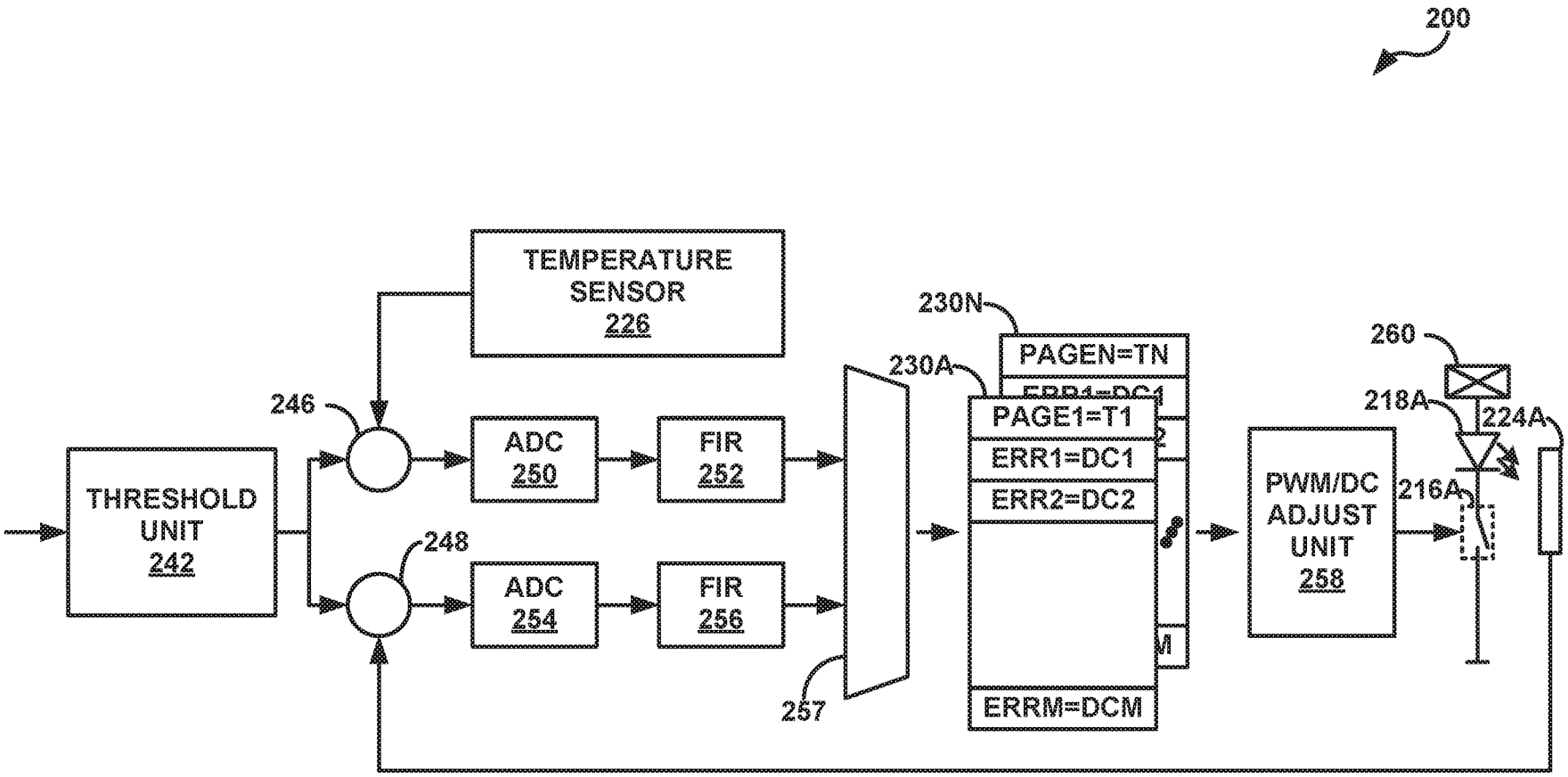
FIG. 2 is a conceptual diagram illustrating a system for controlling a switching device in order to regulate a light intensity of an LED, in accordance with one or more techniques of this disclosure.

FIG. 2 is a conceptual diagram illustrating a system 200 for controlling a switching device 216A in order to regulate a light intensity of an LED 218A, in accordance with one or more techniques of this disclosure. As seen in FIG. 2, system 200 includes switching device 216A, LED 218A, photocurrent sensor 224A, temperature sensor 226, lookup tables 130A-130N (collectively, "lookup tables 130"), threshold unit 242, signal aggregation unit 246, signal aggregation unit 248, analog-to-digital converter (ADC) 250, finite impulse response (FIR) filter 252, ADC 254, FIR filter 256, pulse wave modulation (PWM)/duty cycle (DC) adjust unit 258, and power input 260. Switching device 216A may be an example of one of switching devices 116 of FIG. 1. LED 218A may be an example of one of LEDs 118 of FIG. 1. Photocurrent sensor 224A may be an example of one or more of photocurrent sensor(s) 124 of FIG. 1. Temperature sensor 226 may represent temperature sensor 126 of FIG. 1. Lookup tables 230 may be examples of at least some of lookup tables of FIG. 1. Threshold unit 242, signal aggregation unit 246, signal aggregation unit 248, ADC 250, FIR filter 252, ADC 254, FIR filter 256, and PWM/DC adjust unit 258 may, in some cases, represent at least some of processing circuitry 112 of FIG. 1.

Switching device 216A may control whether electrical current flows from power input 260 through LED 218A, causing LED 218A to emit light. For example, in cases where switching device 216A is turned on (e.g., switching device 216A is closed), electrical current flows through LED 218 and switching device 216A to ground. As the electrical current flows through LED 218A, LED 218A emits photons (e.g., light). Alternatively, in cases where switching device 216A is turned off (e.g., switching device 216A is open), electrical current does not flow through LED 218A and LED 218A does not emit photons. In addition to controlling whether electrical current flows through LED 218A, switching device 216A may, in some cases, control an amount of electrical current output from LED 218A per unit time. For example, PWM/DC Adjust Unit 258 may control switching device 216A to alternate between an off state and an on state at a frequency value and a duty cycle value. The frequency may represent a rate in which switching device 216A completes switching cycles, where each switching cycle includes an 'on' phase and a respective 'off' phase. The duty cycle may represent a ratio of a duration of an 'on' phase of a switching cycle to a total duration of the switching cycle. For example, a duty cycle of 0.7 may indicate that 70% of a switching cycle is taken up by the on phase and 30% of the switching cycle is taken up by the off phase. Since LED 218A emits photons during the on phase of switching device 216A and does not emit light during the off phase of switching device 216A, increasing a duty cycle of switching device 216A may cause a light intensity of LED 218A to increase and decreasing a duty cycle of switching device 216A may cause a light intensity of LED 218A to decrease.

Photocurrent sensor 224A may be located proximate to LED 218A. Photocurrent sensor 224A may emit a photocurrent signal which is correlated with a light intensity of LED 218A. In other words, when LED 218A is emitting light at a first light intensity, photocurrent sensor 224A may emit a first photocurrent signal at a first photocurrent signal value and when LED 218A is emitting light at a second light intensity, photocurrent sensor 224A may emit a second photocurrent signal at a second photocurrent signal value. In examples where the first light intensity value is greater than the second light intensity value, the first light intensity value is greater than the second light intensity value. Based on at least the photocurrent signal emitted by Photocurrent sensor 224A, PWM/DC adjust unit 258 may set the duty cycle of switching device 216A so that LED 218A emits photons at a target light intensity.

Threshold unit 242 may receive, as an input, a target light intensity for LED 218A. In some examples, the target light intensity of LED 218A is the same target light intensity associated with at least one other LED not illustrated in FIG. 2. Threshold unit 242 may be configured to select, based on the target light intensity of LED 218A, a threshold temperature value and a threshold photocurrent value. In some examples, threshold unit 242 may be configured to output the threshold photocurrent value to signal aggregation unit 248 and output the threshold temperature value to signal aggregation unit 246. Threshold unit 242 may select the threshold temperature value and the threshold photocurrent value based on a set of threshold lookup tables, where each threshold lookup table of the set of threshold lookup tables includes, for a certain temperature value, a relationship between each target light intensity value of a range of target light intensity values (e.g., a range of luminous flux values) and a respective threshold photocurrent value. In other words, each threshold lookup tables corresponds to a temperature value of a set of temperature values.

Temperature sensor 226 may be configured to generate a temperature signal which indicates a current temperature proximate to LED 218A. In some examples, temperature sensor 226 may include a dedicated temperature sensor circuit. In some examples, temperature sensor 226 may generate the temperature signal based on a forward voltage of the LED 218A. Signal aggregation unit 246 may output, based on receiving the threshold temperature from threshold unit 242 and receiving the temperature signal from temperature sensor 226, a temperature error signal. In some examples, the temperature error signal may represent a difference between the threshold temperature value and the current temperature proximate to LED 218A. ADC 250 may convert the temperature error signal from an analog signal to a digital signal and FIR filter 252 may process the digital temperature error signal so that selection unit 257 may select a lookup table of lookup tables 230 based on the temperature error signal processed by ADC 250 and filtered by FIR filter 252. In some examples, ADC 250 may include one or both of a successive approximation ADC or a sigma-delta ADC.

Signal aggregation unit 248 may output, based on receiving the threshold photocurrent value from threshold unit 242 and receiving the photocurrent signal from photocurrent sensor 224A, a photocurrent error signal. In some examples, the photocurrent error signal may represent a difference between the threshold photocurrent value and the photocurrent value corresponding to LED 218A. ADC 254 may convert the photocurrent error signal from an analog signal to a digital signal and FIR filter 256 may process the digital photocurrent error signal so that selection unit 257 may select a duty cycle delta value from a respective lookup table of lookup tables 230. Selection unit 257 may select the duty cycle delta value from the lookup table in which selection unit 257 selects based on the temperature error signal. In some examples, ADC 254 may include one or both of a successive approximation ADC or a sigma-delta ADC. In some examples, the duty cycle delta value represents a duty cycle correction value to be applied to switching device 216A which controls a flow of electrical current through LED 218A and thus controls the light intensity of LED 218A.

PWM/DC adjust unit 258 may adjust, based on the duty cycle delta value selected by selection unit 257, the duty cycle of switching device 216A from a first duty cycle value to a second duty cycle value. The first duty cycle value may represent the duty cycle of switching device 216A prior to adjustment by PWM/DC adjust unit 258. In some examples, PWM/DC adjust unit 258 may adjust the duty cycle of switching device 216A from the first duty cycle value to the second duty cycle value by calculating a sum of the first duty cycle value and the duty cycle delta value. As such, a negative duty cycle delta value may result in PWM/DC adjust unit 258 decreasing the duty cycle of switching device 216A and a positive duty cycle delta value may result in PWM/DC adjust unit 258 increasing the duty cycle of switching device 216A.

In some examples, each lookup table of lookup tables 230 may include a list of relationships between photocurrent error values and respective duty cycle delta values. For example, the "ERR1=DC1" row of the lookup table 230A indicates that the photocurrent error value "ERR1" is associated with a first duty cycle delta value "DC," the "ERR2=DC2" row of the lookup table 230A indicates that the photocurrent error value "ERR2" is associated with a first duty cycle delta value "DC2." and so on. The photocurrent error values may be numerical, digital values which represent photocurrent error values indicated by the photocurrent error signal processed by ADC 254 and filtered by FIR filter 256. Additionally, in some examples, each lookup table of lookup tables 230 may include a relationship between the respective lookup table and a temperature error value. For example, the "PAGE1=T1" row of the lookup table 230A indicates that the lookup table identifier "PAGE" is associated with the temperature error value "T1" and the "PAGEN=TN" row of the lookup table 230N indicates that the lookup table identifier "PAGEN" is associated with the temperature error value "T1." The temperature error values may be numerical, digital values which represent temperature error values indicated by the temperature error signal processed by ADC 250 and processed by FIR filter 252. In some examples, lookup tables 230 may list delta driver current values to be processed by an internal digital-to-analog converter (DAC) in addition to, or alternatively to the duty cycle delta values listed in lookup tables 230.

In some examples, an additional lookup table (not illustrated in FIG. 2) stores relationships between light intensity values and photocurrent values, a relationship between a first photocurrent threshold and a dark failure, and a relationship between a second photocurrent threshold and a bright failure. In some examples, system 200 may perform a diagnostic process in order to determine whether LED 218A is associated with a bright failure or a dark failure. For example, system 200 may determine that LED 218A is associated with a dark failure if switching device 216A is turned on and a photocurrent value associated with LED 218A is less than the first photocurrent threshold and system 200 may determine that LED 218A is associated with a bright failure if switching device 216A is turned off and a photocurrent value associated with LED 218A is greater than the second photocurrent threshold.

Although system 200 includes one LED 218A and one switching device 216A, system 200 may also include additional LEDs and additional switching devices not illustrated in FIG. 2. In some examples, system 200 may regulate a light intensity of these additional LEDs in addition to regulating the light intensity of LED 218A. Photocurrent sensor 224A, in some examples, may include one or more of these additional LEDs.

Figure 3:
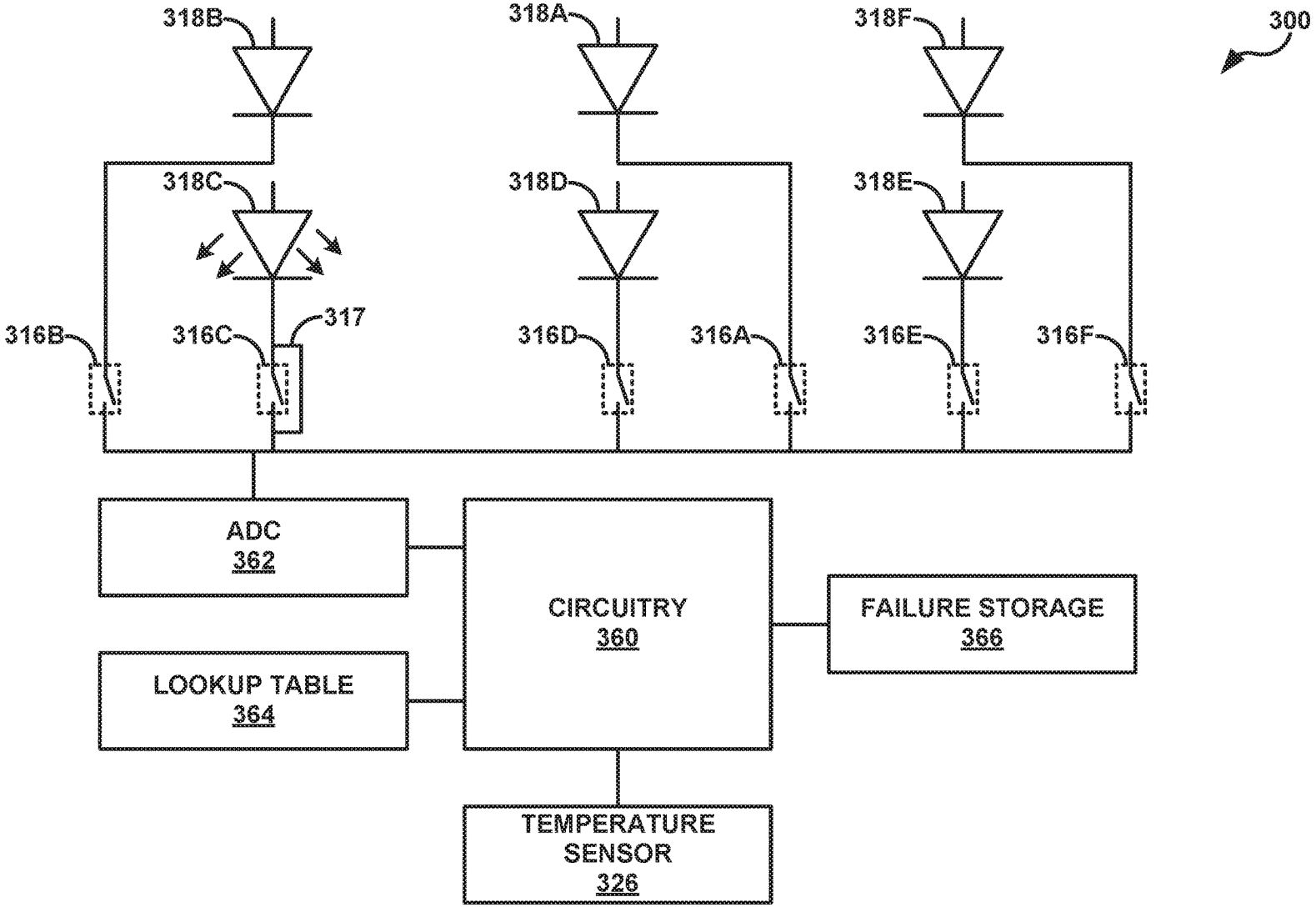
FIG. 3 is a circuit diagram illustrating a system for testing a set of LEDs for one or more failure states, in accordance with one or more techniques of this disclosure.

FIG. 3 is a circuit diagram illustrating a system 300 for testing a set of LEDs 318A-318F for one or more failure states, in accordance with one or more techniques of this disclosure. System 300 includes a set of switching devices 316A-316F (collectively, "switching devices 316," the set of LEDs 318A-318F (collectively, "LEDs 318"), circuitry 360, ADC 362, lookup table 364, failure storage 366, and temperature sensor 326. Switching device 316 may be examples of switching devices 116 of FIG. 1. LEDs 318 may be examples of LEDs 118 of FIG. 1. Temperature sensor 326 may be an example of temperature sensor 126 of FIG. 1. ADC 362 and circuitry 360 may be included by processing circuitry 112 of FIG. 1. Lookup table 334 and failure storage 366 may be stored by memory 114 of FIG. 1.

In some examples, system 300 may test each LED of LEDs 318 on an individual basis to determine whether each LED of LEDs 318 is associated with a bright failure or a dark failure. A bright failure may occur in an LED when a switching device that controls whether the LED receives power from a power source is turned off, yet the LED still emits light. A dark failure may occur in an LED when a switching device that controls whether the LED receives power from a power source is turned on, yet the LED does not emit light. As seen in FIG. 3, LED 318C emits light even though switching device 316C is open (e.g., turned off) due to short 317. ADC 362 may receive a test electrical signal which indicates that LED 318C is emitting light while switching device 316C is open. Circuitry 360 may compare a test voltage value of the test electrical signal with a threshold bright failure voltage value of lookup table 364. If the test voltage value of the test electrical signal is greater than the threshold bright failure voltage value, circuitry 360 may determine that LED 318C is associated with a bright failure and store information in failure storage 366 which indicates that LED 318C is associated with the bright failure. Additionally, circuitry 360 may determine whether an LED is associated with a dark failure.

In some examples, failure storage 366 may maintain a failure count which indicates a number of LEDs of LEDs 318 which are associated with a bright failure or a dark failure. Additionally, failure storage 366 may include information indicative of an identity and/or a location of the LEDs which are associated with a light failure or a dark failure.

Figure 4:
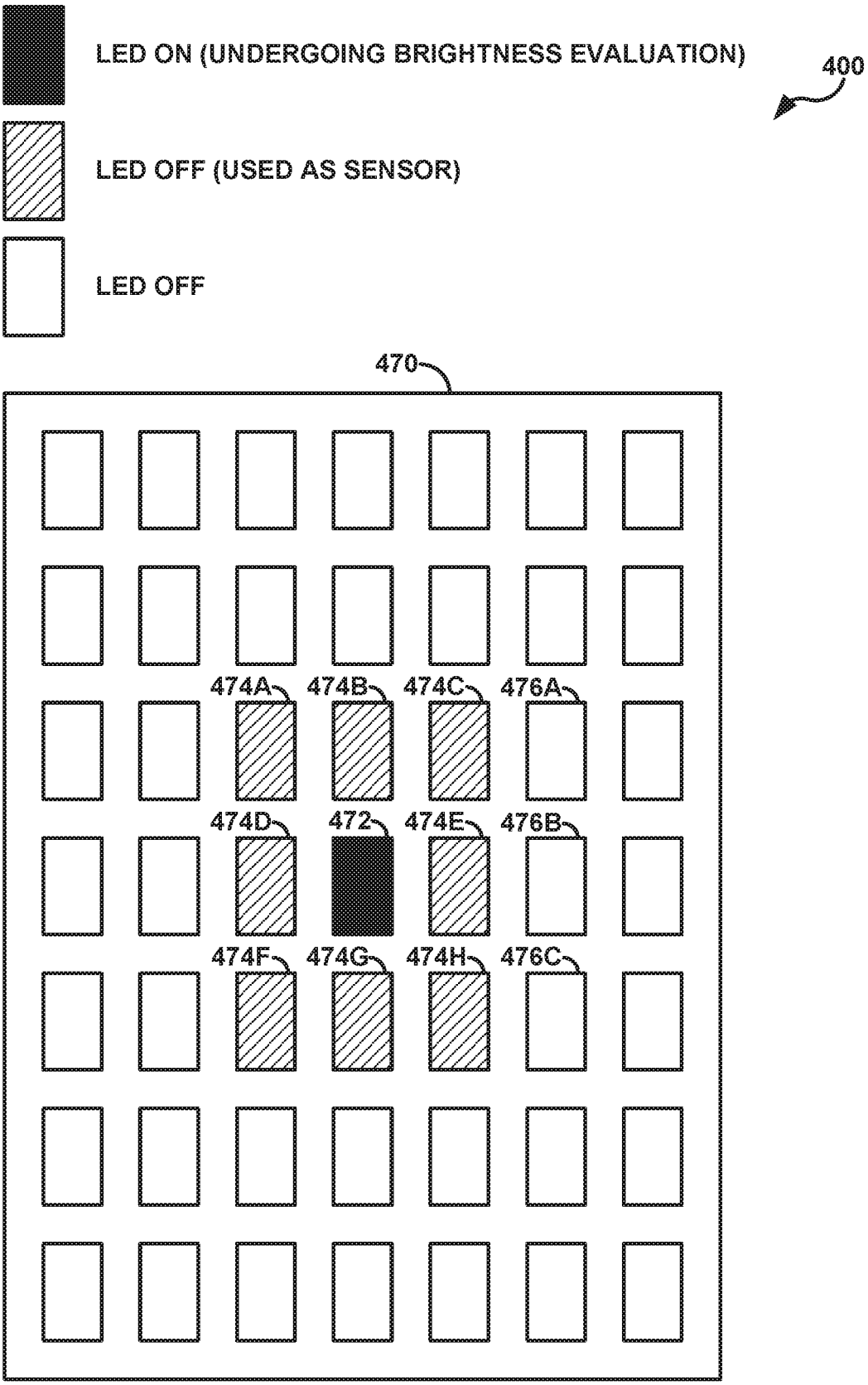
FIG. 4 is a conceptual diagram illustrating an LED matrix which includes an LED undergoing brightness testing and a set of sensing LEDs, in accordance with one or more techniques of this disclosure.

FIG. 4 is a conceptual diagram illustrating an LED matrix 470 which includes an LED 472 undergoing brightness testing and a set of sensing LEDs 474A-474H (collectively, "sensing LEDs 474"), in accordance with one or more techniques of this disclosure. In some examples, LED 472 may be turned on and undergoing a brightness test so that processing circuitry, such as processing circuitry 112 of FIG. 1, may control a light intensity of LED 472. Sensing LEDs 474 may be turned off and while sensing LEDs 474 are turned off, sensing LEDs 474 may perform as photocurrent sensors which generate a set of photocurrent signal components indicative of the light intensity of LED 472. Each photocurrent signal component of the set of photocurrent signal components corresponds to one of the set of sensing LEDs 474. In some examples, processing circuitry 112 is configured to determine the photocurrent value based on a mean photocurrent value component of the set of photocurrent value components. In some examples, processing circuitry 112 is configured to determine the photocurrent value based on a median photocurrent value component of the set of photocurrent value components.

As seen in FIG. 4, the set of sensing LEDs 474 may include sensing LED 474A, sensing LED 474B, sensing LED 474C, sensing LED, 474D, sensing LED 474E, sensing LED 474F, sensing LED 474G, and sensing LED 474H while LED 472 is undergoing brightness testing, because these LEDs represent the LEDs of matrix 470 which are horizontally adjacent to LED 472, vertically adjacent to LED 472, or kitty-corner to LED 472 and are thus the closest LEDs to LED 472. As such, sensing LEDs 474 may be the best LEDs for sensing a light intensity of LED 472. After measuring a light intensity of LED 472, processing circuitry 112 may measure the light intensity of another LED of matrix 470, such as LED 474E. In this example, the set of sensing LEDs may change in order to include LED 472, LED 474B, LED 474C, LED 474G, LED 474H, and LEDs 476A-476C, because these LEDs represent the LEDs of matrix 470 which are horizontally adjacent to LED 474E, vertically adjacent to LED 474E, or kitty-corner to LED 474E and are thus the closest LEDs to LED 474E. As such, this new set of sensing LEDs may be the best LEDs for sensing a light intensity of LED 474E.

Processing circuitry 112 may measure the light intensity of any LED of LED matrix 470 by collecting a photocurrent signal component corresponding to each LED which is horizontally adjacent to the LED being evaluated for light intensity, vertically adjacent to the LED being evaluated for light intensity, or kitty-corner to the LED being evaluated for light intensity. In some examples, processing circuitry 112 may cycle through each of the LEDs of LED matrix 470 in order to measure the light intensity of each LED of the LED matrix 470.

Figure 5:
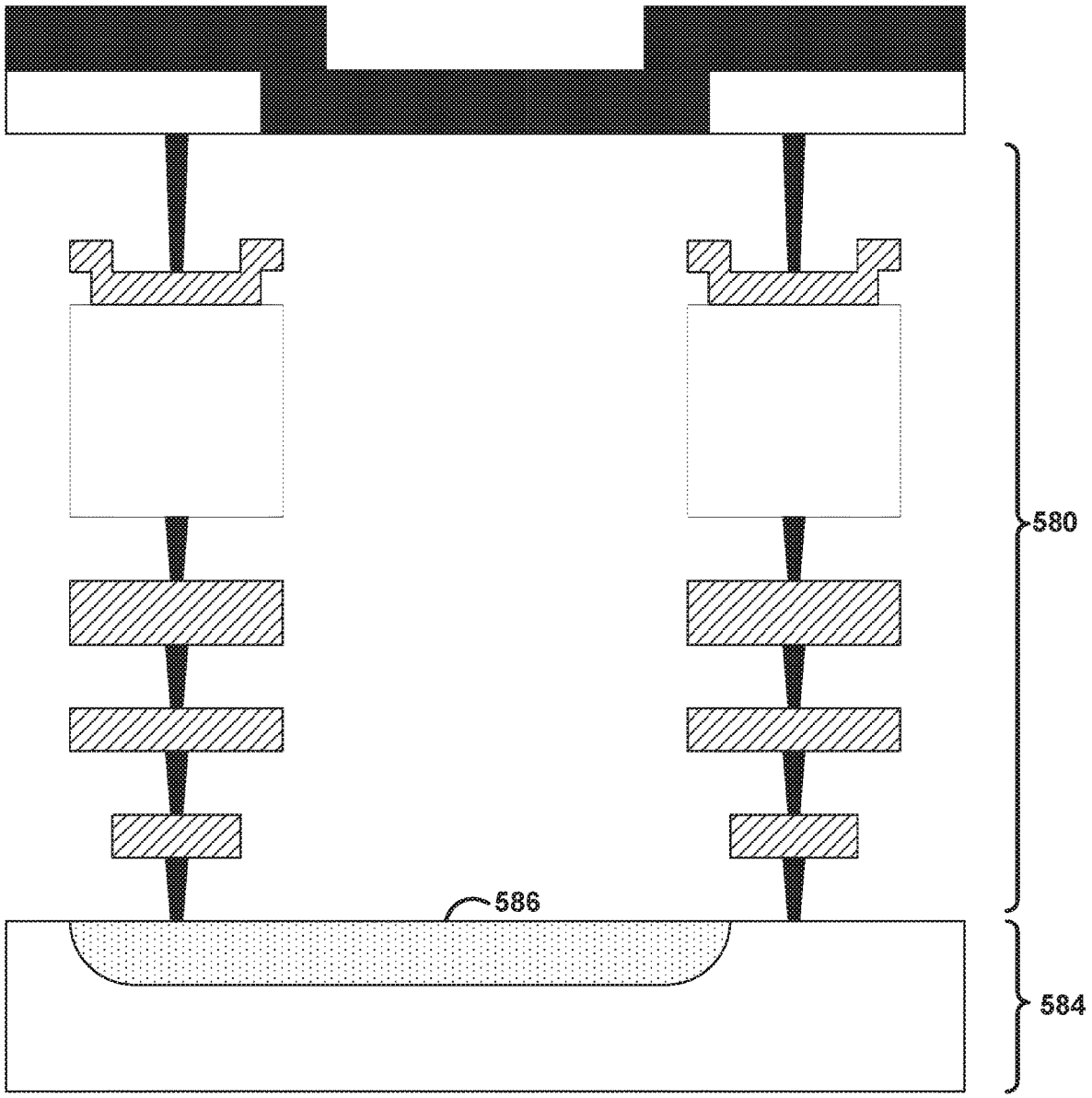
FIG. 5 is a conceptual diagram illustrating a first integrated photodiode and a second integrated photodiode, in accordance with one or more techniques of this disclosure.

FIG. 5 is a conceptual diagram illustrating an optical channel 580 connected to an integrated photodiode 584, in accordance with one or more techniques of this disclosure. In some examples, a leakage current 586 may form in a p-doping area of the integrated photodiode 584. The optical channel 580 may be embedded inside a substrate and surrounded with trenches in order to avoid excess leakage current caused by light entering other parts of the chip. In some cases, an optical channel of the set of optical channels may correspond to each respective LED of LEDs 118 of FIG. 1. In some cases, at least one LED of LEDs 118 might not be associated with an optical channel. Integrated photodiode 584 may detect leakage current 586. In some examples, a magnitude of leakage current 586 is correlated with a light intensity of the LED corresponding to optical channel 580.

In some examples, the substrate which encloses the optical channel 580 might not include a passivation opening in order to prevent damage to the optical channel 580 by an outside environment. In some examples, the optical channel 580 may include a seal ring in order to prevent leakage current from forming due to scattered light.

Figure 6:
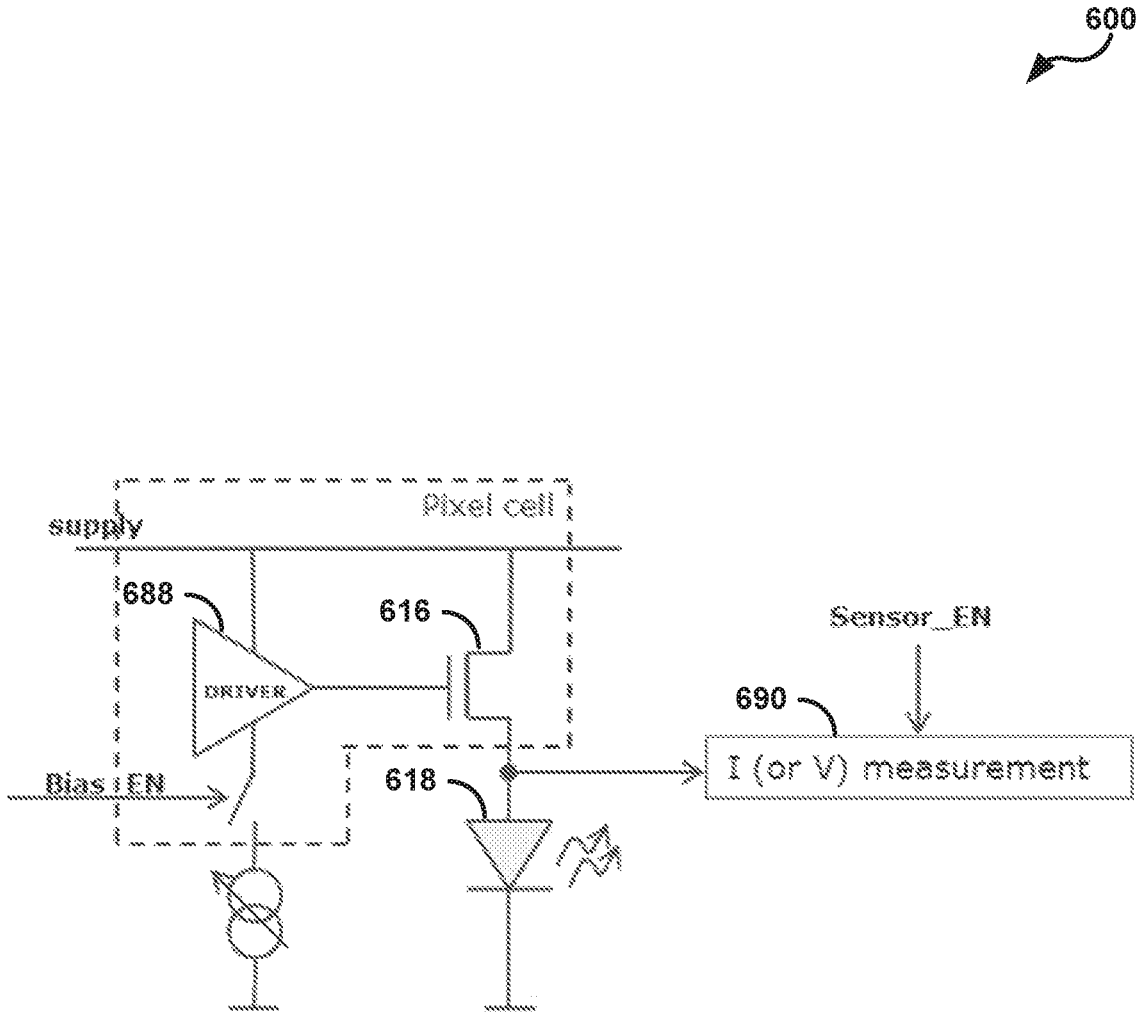
FIG. 6 is a circuit diagram illustrating a gate driver for a switching device that controls whether an LED is turned on, is turned off, or is turned off and used as a sensor, in accordance with one or more techniques of this disclosure.

FIG. 6 is a circuit diagram 600 illustrating a gate driver 688 for a switching device 616 that controls whether LED 618 is turned on, is turned off, or is turned off and used as a sensor, in accordance with one or more techniques of this disclosure. When switching device 616 is turned on and LED 618 gives off light, the "Bias_EN" signal may enable driver 688 to turn on switching device 616 and provide current to LED 618, while the measurement unit 690 is disabled. In order to use LED 618 as a sensor, the "Bias_EN" may be set to a low value and use the "Sensor_EN" signal may be set to a high value, causing gate driver 688 to turn off switching device 616 and allowing measurement unit 690 to measure an electrical signal flowing through LED 618. In this way, measurement unit 690 unit may be enabled and measurement unit 690 may read the photocurrent signal which is proportional to a light intensity of a neighboring LED.

Figure 7:
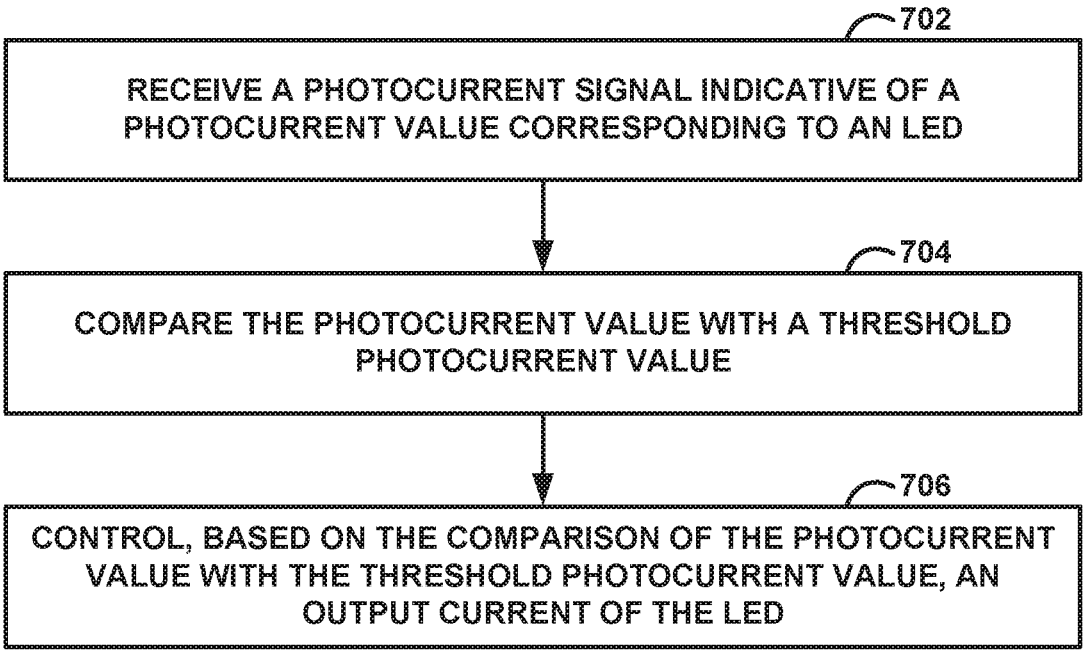
FIG. 7 is a flow diagram illustrating an example operation for controlling an output current of an LED, in accordance with one or more techniques of this disclosure.

FIG. 7 is a flow diagram illustrating an example operation for controlling an output current of an LED, in accordance with one or more techniques of this disclosure. FIG. 7 is described with respect to system 100 of FIG. 1. However, the techniques of FIG. 7 may be performed by different components of system 100 or by additional or alternative systems.

Processing circuitry 112 is configured to receive a photocurrent signal indicative of a photocurrent value corresponding to an LED of LEDs 118 (702). In some examples, the photocurrent signal may be correlated with a light intensity of the LED. Processing circuitry 112 may compare the photocurrent value with a threshold photocurrent value (704). In some examples, processing circuitry 112 may calculate a photocurrent error value based on the photocurrent value and the threshold photocurrent value. In some examples, the photocurrent error value represents a difference between the photocurrent value and the threshold photocurrent value. Processing circuitry 112 may control, based on the comparison of the photocurrent value with the threshold photocurrent value, an output current of the LED of LEDs 118 (706). In some examples, processing circuitry 112 may control the output current by altering the duty cycle of a switching device of switching devices 116 which controls a flow of electrical current through the LED. In some examples, processing circuitry 112 may control the output current by altering the input current to the LED.

Figure 8:
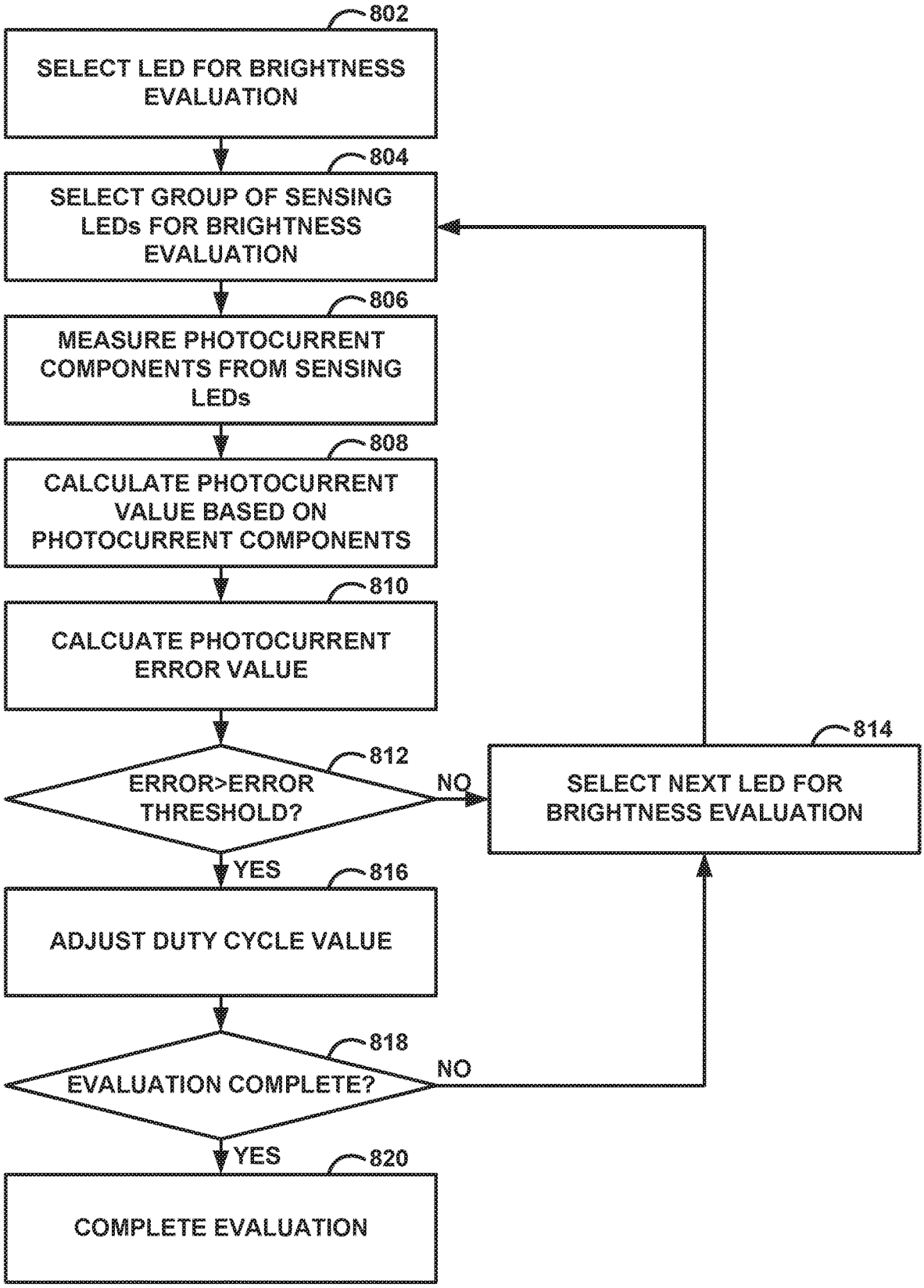
FIG. 8 is a flow diagram illustrating an example operation for regulating a light intensity of an LED to match a target light intensity, in accordance with one or more techniques of this disclosure.

FIG. 8 is a flow diagram illustrating an example operation for regulating a light intensity of an LED to match a target light intensity, in accordance with one or more techniques of this disclosure. FIG. 8 is described with respect to system 100 of FIG. 1. However, the techniques of FIG. 8 may be performed by different components of system 100 or by additional or alternative systems.

Processing circuitry 112 may select a first LED of LEDs 118 for brightness evaluation (802). Additionally, in some cases, processing circuitry 112 may turn on the first LED selected for brightness evaluation, causing the LED to emit light. Processing circuitry 112 may select a group of sensing LEDs of LEDs 118 for the brightness evaluation of the first LED (804). LEDs 118 may from a matrix of LEDs having a number of rows and a number of columns, in some cases. Processing circuitry 112 may select the group of sensing LEDs to include LEDs which are proximate to the first LED, such as LEDs which are vertically adjacent to the first LED, horizontally adjacent to the first LED, or kitty-corner to the first LED within the LED matrix. Processing circuitry 112, in some examples, may activate a sensing mode for each LED of the set of sensing LEDs and turn off each LED of the set of sensing LEDs.

The set of sensing LEDs may measure a set of photocurrent value components (806), where each photocurrent value components of the set of photocurrent value components corresponds to a respective LED of the set of sensing LEDs. Processing circuitry 112 may calculate a photocurrent value based on the set of photocurrent value components (808). In some examples, processing circuitry 112 calculates the photocurrent value to be a mean of the set of photocurrent value components. In some examples, processing circuitry 112 calculates the photocurrent value to be a median of the set of photocurrent value components. Processing circuitry 112 may calculate a photocurrent error value (810) based on the photocurrent error value. In some examples, processing circuitry 112 may select a photocurrent reference value based on a target light intensity for the first LED and processing circuitry 112 calculates the photocurrent error value based on the photocurrent reference value and the photocurrent value determined based on the set of photocurrent value components.

Processing circuitry 112 determines whether the photocurrent error value is greater than a photocurrent error threshold (812). If the photocurrent error value is not greater than the photocurrent error threshold ("NO" branch of block 812), processing circuitry 112 may select a next LED for brightness evaluation (814). If the photocurrent error value is greater than the photocurrent error threshold ("YES" branch of block 812), processing circuitry 112 may adjust a duty cycle of a switching device which controls whether the first LED receives power from a power source (816). In some examples, processing circuitry 112 may select the duty cycle from a duty cycle lookup table. Processing circuitry 112 may determine whether the brightness evaluation is complete (818). If the brightness evaluation is not complete ("NO" branch of block 818), processing circuitry 112 may select the next LED for brightness evaluation (814). If the brightness evaluation is complete ("YES" branch of block 818), processing circuitry 112 may complete the brightness evaluation of LEDs 118 (820).

The following numbered examples demonstrate one or more aspects of the disclosure.

Example 1. A circuit for controlling a plurality of light emitting diodes (LEDs), the circuit comprising: a switching device, wherein the switching device is electrically connected to an LED of the plurality of LEDs, and wherein the switching device is configured to control whether the LED receives an electrical signal from a power source; and processing circuitry configured to: receive a photocurrent signal indicative of a photocurrent value corresponding to the LED; compare the photocurrent value with a threshold photocurrent value; and control, based on the comparison of the photocurrent value with the threshold photocurrent value, an output current of the LED.

Example 2. The circuit of example 1, wherein to control the output current of the LED, the processing circuitry is configured to: adjust, based on the comparison between the photocurrent value and the threshold photocurrent value, a duty cycle from a first duty cycle value to a second duty cycle value; and modulate the switching device at the second duty cycle value.

Example 3. The circuit of examples 1-2 or any combination thereof, wherein to compare the photocurrent value with the threshold photocurrent value, the processing circuitry is configured to determine a difference between the photocurrent value and the threshold photocurrent value, and wherein to adjust the duty cycle value from the first duty cycle value to the second duty cycle value, the processing circuitry is configured to: identify a duty cycle delta value based on the difference between the photocurrent value and the threshold photocurrent value; and adjust the duty cycle from the first duty cycle value to the second duty cycle value by calculating a sum of the first duty cycle value and the duty cycle delta value.

Example 4. The circuit of examples 1-3 or any combination thereof, wherein the processing circuitry is further configured to: select, based on a temperature signal received from a temperature sensor, the threshold photocurrent value based on the temperature signal; identify the duty cycle delta value based on a lookup table of a set of lookup tables, wherein each lookup table of the set of lookup tables corresponds to a respective temperature value; and select the lookup table of the set of lookup tables based on the temperature signal.

Example 5. The circuit of examples 1-4 or any combination thereof, wherein to control the output current of the LED, the processing circuitry is configured to adjust, based on the comparison between the photocurrent value and the threshold photocurrent value, an input current to the LED from a first input current value to a second input current value.

Example 6. The circuit of examples 1-5 or any combination thereof, wherein the circuit further comprises a photocurrent sensor proximate to the LED, the photocurrent sensor configured to: generate the photocurrent signal; and output the photocurrent signal to the processing circuitry.

Example 7. The circuit of examples 1-6 or any combination thereof, wherein the photocurrent sensor includes a photodiode integrated with the LED, wherein to generate the photocurrent signal, the photodiode is configured to generate the photocurrent signal to indicate the photocurrent value which is proportional to a light intensity of the LED, and wherein the processing circuitry is configured to adjust the output current of the LED in order to cause the LED to emit light at a target light intensity.

Example 8. The circuit of examples 1-7 or any combination thereof, wherein to generate the photocurrent signal, the photodiode is configured to: detect an amount of leakage current associated with the LED; and generate the photocurrent signal to indicate the photocurrent value based on the amount of leakage current associated with the LED.

Example 9. The circuit of examples 1-8 or any combination thereof, wherein the plurality of LEDs form an LED matrix that includes a number of columns and a number of rows, wherein the photocurrent sensor comprises a group of one or more sensing LEDs of the set of LEDs, each sensing LED of the group of one or more sensing LEDs being proximate to the LED, and wherein the group of one or more sensing LEDs are configured to generate the photocurrent signal to include a set of photocurrent value components, wherein each photocurrent value component of the set of photocurrent value components corresponds to a respective sensing LED of the group of one or more sensing LEDs.

Example 10. The circuit of examples 1-9 or any combination thereof, wherein after receiving the photocurrent signal, the processing circuitry is configured to determine the photocurrent value based on a mean photocurrent value component of the set of photocurrent value components.

Example 11. The circuit of examples 1-10 or any combination thereof, wherein after receiving the photocurrent signal, the processing circuitry is configured to determine the photocurrent value based on a median photocurrent value component of the set of photocurrent value components.

Example 12. The circuit of examples 1-11 or any combination thereof, wherein the LED is a first LED wherein the photocurrent signal is a first photocurrent signal, wherein the photocurrent value is a first photocurrent value, wherein the output current is a first output current, wherein the switching device is a first switching device, and wherein after controlling the switching device to adjust the output current, the processing circuitry is configured to: receive a second photocurrent signal indicative of a second photocurrent value corresponding to a second LED of the plurality of LEDs, wherein the second LED is a part of the group of one or more sensing LEDs compare the second photocurrent value with the threshold photocurrent value: and control, based on the comparison of the second photocurrent value with the threshold photocurrent value, a second switching device to adjust a second output current of the second LED, wherein the second switching device is configured to control whether the second LED receives the electrical signal from the power source.

Example 13. A method for controlling a plurality of light emitting diodes (LEDs), the method comprising: receiving, by processing circuitry, a photocurrent signal indicative of a photocurrent value corresponding to an LED of a plurality of LEDs, wherein a switching device is electrically connected to the LED, and wherein the switching device is configured to control whether the LED receives an electrical signal from a power source; comparing, by the processing circuitry, the photocurrent value with a threshold photocurrent value: and controlling, by the processing circuitry based on the comparison of the photocurrent value with the threshold photocurrent value, an output current of the LED.

Example 14. The method of example 13, wherein controlling the output current of the LED comprises: adjusting, based on the comparison between the photocurrent value and the threshold photocurrent value, a duty cycle from a first duty cycle value to a second duty cycle value; and modulating the switching device at the second duty cycle value.

Example 15. The method of examples 13-14 or any combination thereof, wherein comparing the photocurrent value with the threshold photocurrent value comprises determining a difference between the photocurrent value and the threshold photocurrent value, and wherein adjusting the duty cycle value from the first duty cycle value to the second duty cycle value comprises: identifying a duty cycle delta value based on the difference between the photocurrent value and the threshold photocurrent value; and adjusting the duty cycle from the first duty cycle value to the second duty cycle value by calculating a sum of the first duty cycle value and the duty cycle delta value.

Example 16. The method of examples 13-15 or any combination thereof, wherein the method further comprises: selecting, by the processing circuitry based on a temperature signal received from a temperature sensor, the threshold photocurrent value based on the temperature signal: identifying, by the processing circuitry, the duty cycle delta value based on a lookup table of a set of lookup tables, wherein each lookup table of the set of lookup tables corresponds to a respective temperature value; and selecting, by the processing circuitry, the lookup table of the set of lookup tables based on the temperature signal.

Example 17. The method of examples 13-16 or any combination thereof, wherein controlling the output current of the LED comprises adjusting, based on the comparison between the photocurrent value and the threshold photocurrent value, an input current to the LED from a first input current value to a second input current value.

Example 18. The method of examples 13-17 or any combination thereof, wherein the method further comprises: generating, by a photocurrent sensor proximate to the LED, the photocurrent signal; and outputting, by the photocurrent sensor, the photocurrent signal to the processing circuitry.

Example 19. The method of examples 13-18 or any combination thereof, wherein the photocurrent sensor includes a photodiode integrated with the LED, wherein generating the photocurrent signal comprises generating, by the photodiode, the photocurrent signal to indicate the photocurrent value which is proportional to a light intensity of the LED, and wherein the processing circuitry is configured to adjust the output current of the LED in order to cause the LED to emit light at a target light intensity.

Example 20. The method of examples 13-19 or any combination thereof, wherein generating the photocurrent signal comprises: detecting, by the photodiode, an amount of leakage current associated with the LED: and generating, by the photodiode, the photocurrent signal to indicate the photocurrent value based on the amount of leakage current associated with the LED.

Example 21. The method of examples 13-20 or any combination thereof, wherein the plurality of LEDs form an LED matrix that includes a number of columns and a number of rows, wherein the photocurrent sensor comprises a group of one or more sensing LEDs of the set of LEDs, each sensing LED of the group of one or more sensing LEDs being proximate to the LED, and wherein generating the photocurrent signal comprises generating, using the group of one or more sensing LEDs, the photocurrent signal to include a set of photocurrent value components, wherein each photocurrent value component of the set of photocurrent value components corresponds to a respective sensing LED of the group of one or more sensing LEDs.

Example 22. The method of examples 13-21 or any combination thereof, wherein after receiving the photocurrent signal, the method further comprises determining, by the processing circuitry, the photocurrent value based on a mean photocurrent value component of the set of photocurrent value components.

Example 23. The method of examples 13-22 or any combination thereof, wherein after receiving the photocurrent signal, the method further comprises determining, by the processing circuitry, the photocurrent value based on a median photocurrent value component of the set of photocurrent value components.

Example 24. The method of examples 13-23 or any combination thereof, wherein the LED is a first LED, wherein the photocurrent signal is a first photocurrent signal, wherein the photocurrent value is a first photocurrent value, wherein the output current is a first output current, wherein the switching device is a first switching device, and wherein after controlling the switching device to adjust the output current, the method further comprises: receiving, by the processing circuitry, a second photocurrent signal indicative of a second photocurrent value corresponding to a second LED of the plurality of LEDs, wherein the second LED is a part of the group of one or more sensing LEDs; comparing, by the processing circuitry, the second photocurrent value with the threshold photocurrent value; and controlling, by the processing circuitry based on the comparison of the second photocurrent value with the threshold photocurrent value, a second switching device to adjust a second output current of the second LED, wherein the second switching device is configured to control whether the second LED receives the electrical signal from the power source.

Example 25. A system for controlling a plurality of light emitting diodes (LEDs), the system comprising: the plurality of LEDs; a switching device, wherein the switching device is electrically connected to an LED of the plurality of LEDs, and wherein the switching device is configured to control whether the LED receives an electrical signal from a power source; and processing circuitry configured to: receive a photocurrent signal indicative of a photocurrent value corresponding to the LED; compare the photocurrent value with a threshold photocurrent value; and control, based on the comparison of the photocurrent value with the threshold photocurrent value, an output current of the LED.

Example 26. The system of example 25, wherein to control the output current of the LED, the processing circuitry is configured to: adjust, based on the comparison between the photocurrent value and the threshold photocurrent value, a duty cycle from a first duty cycle value to a second duty cycle value: and modulate the switching device at the second duty cycle value.

Various examples of the disclosure have been described. These and other examples are within the scope of the following claims.

What is claimed is:

1. A circuit for controlling a plurality of light emitting diodes (LEDs), the circuit comprising:

a switching device, wherein the switching device is electrically connected to an LED of the plurality of LEDs, and wherein the switching device is configured to control whether the LED receives an electrical signal from a power source; and processing circuitry configured to:

receive, from a set of sensing LEDs of the plurality of LEDs, a set of photocurrent value components indicative of a photocurrent value corresponding to the LED, wherein the plurality of LEDs form an LED matrix that includes a number of columns and a number of rows, wherein each sensing LED of the set of sensing LEDs is proximate to the LED in the LED matrix;

determine the photocurrent value based on the set of photocurrent value components;

compare the photocurrent value with a threshold photocurrent value; and control, based on the comparison of the photocurrent value with the threshold photocurrent value, an output current of the LED.

2. The circuit of claim 1, wherein to control the output current of the LED, the processing circuitry is configured to:

adjust, based on the comparison between the photocurrent value and the threshold photocurrent value, a duty cycle from a first duty cycle value to a second duty cycle value; and modulate the switching device at the second duty cycle value.

3. The circuit of claim 2, wherein to compare the photocurrent value with the threshold photocurrent value, the processing circuitry is configured to determine a difference between the photocurrent value and the threshold photocurrent value, and wherein to adjust the duty cycle value from the first duty cycle value to the second duty cycle value, the processing circuitry is configured to:

identify a duty cycle delta value based on the difference between the photocurrent value and the threshold photocurrent value; and adjust the duty cycle from the first duty cycle value to the second duty cycle value by calculating a sum of the first duty cycle value and the duty cycle delta value.

4. The circuit of claim 3, wherein the processing circuitry is further configured to:

select, based on a temperature signal received from a temperature sensor, the threshold photocurrent value based on the temperature signal;

identify the duty cycle delta value based on a lookup table of a set of lookup tables, wherein each lookup table of the set of lookup tables corresponds to a respective temperature value; and select the lookup table of the set of lookup tables based on the temperature signal.

5. The circuit of claim 1, wherein to control the output current of the LED, the processing circuitry is configured to adjust, based on the comparison between the photocurrent value and the threshold photocurrent value, an input current to the LED from a first input current value to a second input current value.

6. The circuit of claim 1, wherein the circuit further comprises the set of sensing LEDs, wherein the set of sensing LEDs are configured to:

generate the set of photocurrent value components; and output the set of photocurrent value components to the processing circuitry.

7. The circuit of claim 1, wherein the set of sensing LEDs are configured to generate the set of photocurrent value components, wherein each photocurrent value component of the set of photocurrent value components corresponds to a respective sensing LED of the set of sensing LEDs.

8. The circuit of claim 7, wherein after receiving the set of photocurrent value components, the processing circuitry is configured to determine the photocurrent value based on a mean photocurrent value component of the set of photocurrent value components.

9. The circuit of claim 7, wherein after receiving the set of photocurrent value components, the processing circuitry is configured to determine the photocurrent value based on a median photocurrent value component of the set of photocurrent value components.

10. The circuit of claim 7, wherein the LED is a first LED, wherein the set of photocurrent value components is a first set of photocurrent value components, wherein the photocurrent value is a first photocurrent value, wherein the output current is a first output current, wherein the switching device is a first switching device, and wherein after controlling the switching device to adjust the output current, the processing circuitry is configured to:

receive, from a second set of sensing LEDs of the plurality of LEDs, a second set of photocurrent value components indicative of a second photocurrent value corresponding to a second LED of the plurality of LEDs, wherein the second LED is a part of the first set of sensing LEDs;

determine the second photocurrent value based on the second set of photocurrent value components;

compare the second photocurrent value with the threshold photocurrent value; and control, based on the comparison of the second photocurrent value with the threshold photocurrent value, a second switching device to adjust a second output current of the second LED, wherein the second switching device is configured to control whether the second LED receives the electrical signal from the power source.

11. A method for controlling a plurality of light emitting diodes (LEDs), the method comprising:

receiving, by processing circuitry from a set of sensing LEDs of the plurality of LEDs, a set of photocurrent value components indicative of a photocurrent value corresponding to an LED of the plurality of LEDs wherein the plurality of LEDs form an LED matrix that includes a number of columns and a number of rows, wherein each sensing LED of the set of sensing LEDs is proximate to the LED in the LED matrix, wherein a switching device is electrically connected to the LED, and wherein the switching device is configured to control whether the LED receives an electrical signal from a power source;

determining, by the processing circuitry, the photocurrent value based on the set of photocurrent value components;

comparing, by the processing circuitry, the photocurrent value with a threshold photocurrent value; and controlling, by the processing circuitry based on the comparison of the photocurrent value with the threshold photocurrent value, an output current of the LED.

12. The method of claim 11, wherein controlling the output current of the LED comprises:

adjusting, based on the comparison between the photocurrent value and the threshold photocurrent value, a duty cycle from a first duty cycle value to a second duty cycle value; and modulating the switching device at the second duty cycle value.

13. The method of claim 12, wherein comparing the photocurrent value with the threshold photocurrent value comprises determining a difference between the photocurrent value and the threshold photocurrent value, and wherein adjusting the duty cycle value from the first duty cycle value to the second duty cycle value comprises:

identifying a duty cycle delta value based on the difference between the photocurrent value and the threshold photocurrent value; and adjusting the duty cycle from the first duty cycle value to the second duty cycle value by calculating a sum of the first duty cycle value and the duty cycle delta value.

14. The method of claim 13, wherein the method further comprises:

selecting, by the processing circuitry based on a temperature signal received from a temperature sensor, the threshold photocurrent value based on the temperature signal;

identifying, by the processing circuitry, the duty cycle delta value based on a lookup table of a set of lookup tables, wherein each lookup table of the set of lookup tables corresponds to a respective temperature value; and selecting, by the processing circuitry, the lookup table of the set of lookup tables based on the temperature signal.

15. The method of claim 11, wherein controlling the output current of the LED comprises adjusting, based on the comparison between the photocurrent value and the threshold photocurrent value, an input current to the LED from a first input current value to a second input current value.

16. The method of claim 11, wherein the method further comprises:

generating, by the set of sensing LEDs, the set of photocurrent value components; and outputting, by the set of sensing LEDs, the set of photocurrent value components to the processing circuitry.

17. The method of claim 1, wherein generating the photocurrent signal comprises generating, using the set of sensing LEDs, the set of photocurrent value components, wherein each photocurrent value component of the set of photocurrent value components corresponds to a respective sensing LED of the set of sensing LEDs.

18. The method of claim 17, wherein after receiving the set of photocurrent value components, the method further comprises determining, by the processing circuitry, the photocurrent value based on a mean photocurrent value component of the set of photocurrent value components.

19. The method of claim 17, wherein after receiving the set of photocurrent value components, the method further comprises determining, by the processing circuitry, the photocurrent value based on a median photocurrent value component of the set of photocurrent value components.

20. The method of claim 17, wherein the LED is a first LED, wherein the set of photocurrent value components is a first set of photocurrent value components, wherein the photocurrent value is a first photocurrent value, wherein the output current is a first output current, wherein the switching device is a first switching device, and wherein after controlling the switching device to adjust the output current, the method further comprises:

receiving, by the processing circuitry from a second set of sensing LEDs of the plurality of LEDs, a second set of photocurrent value components indicative of a second photocurrent value corresponding to a second LED of the plurality of LEDs, wherein the second LED is a part of the first set of sensing LEDs;

determining, by the processing circuitry, the second photocurrent value based on the second set of photocurrent value components;

comparing, by the processing circuitry, the second photocurrent value with the threshold photocurrent value; and controlling, by the processing circuitry based on the comparison of the second photocurrent value with the threshold photocurrent value, a second switching device to adjust a second output current of the second LED, wherein the second switching device is configured to control whether the second LED receives the electrical signal from the power source.

21. A system for controlling a plurality of light emitting diodes (LEDs), the system comprising:

the plurality of LEDs;

a switching device, wherein the switching device is electrically connected to an LED of the plurality of LEDs, and wherein the switching device is configured to control whether the LED receives an electrical signal from a power source; and processing circuitry configured to:

receive, from a set of sensing LEDs of the plurality of LEDs, a set of photocurrent value components indicative of a photocurrent value corresponding to the LED, wherein the plurality of LEDs form an LED matrix that includes a number of columns and a number of rows, wherein each sensing LED of the set of sensing LEDs is proximate to the LED in the LED matrix;

determine the photocurrent value based on the set of photocurrent value components;

compare the photocurrent value with a threshold photocurrent value; and control, based on the comparison of the photocurrent value with the threshold photocurrent value, an output current of the LED.

22. The system of claim 21, wherein to control the output current of the LED, the processing circuitry is configured to:

adjust, based on the comparison between the photocurrent value and the threshold photocurrent value, a duty cycle from a first duty cycle value to a second duty cycle value; and modulate the switching device at the second duty cycle value.

* * * * *